US011058233B1

(12) United States Patent
Fedorko

(10) Patent No.: US 11,058,233 B1
(45) Date of Patent: Jul. 13, 2021

(54) MODULAR DISPLAY CASE

(71) Applicant: Donald J. Fedorko, Des Peres, MO (US)

(72) Inventor: Donald J. Fedorko, Des Peres, MO (US)

( * ) Notice: Subject to any disclaimer, the term of this patent is extended or adjusted under 35 U.S.C. 154(b) by 0 days.

(21) Appl. No.: 16/566,935

(22) Filed: Sep. 11, 2019

Related U.S. Application Data

(60) Provisional application No. 62/729,734, filed on Sep. 11, 2018.

(51) Int. Cl.
*A47G 1/12* (2006.01)
*A47F 3/00* (2006.01)

(52) U.S. Cl.
CPC ..... *A47F 3/001* (2013.01); *A47F 3/005* (2013.01); *A47G 1/12* (2013.01)

(58) Field of Classification Search
CPC .... A47B 2220/0077; A47F 3/00; A47F 3/001; A47F 3/005; A47F 3/007; A47G 1/12
USPC ..... 40/546, 611.05, 611.08, 611.1, 781, 800, 40/714; 206/769, 771; 312/114, 223.5; 428/14
See application file for complete search history.

(56) References Cited

U.S. PATENT DOCUMENTS 2,535,149 A 12/1950 McBride
2,841,272 A 7/1958 Reier
3,318,032 A 5/1967 Robison
4,271,619 A 6/1981 Schmidt
D297,896 S 10/1988 Welborn
4,879,145 A * 11/1989 McLellan ..... A47G 1/12 428/14
D310,454 S 9/1990 Beasley
5,277,949 A * 1/1994 Green ..... G09F 19/00 428/13
5,303,489 A 4/1994 Blegen
5,383,293 A * 1/1995 Royal ..... A47G 1/0616 40/768
7,028,425 B2 4/2006 Lasher
7,080,918 B2 7/2006 Rowland
7,219,460 B1 5/2007 Grayson
(Continued)

OTHER PUBLICATIONS

Living Patriot, LLC, Shop [online], Apr. 16, 2011. Retrieved from the Internet: <http://web.archive.org/web/20110416010514/http://www.livingpatriot.com/prism-photos/>.
(Continued)

*Primary Examiner* — Kristina N Junge
(74) *Attorney, Agent, or Firm* — Creativenture Law, LLC; Dennis JM Donahue, III; Kevin C. Staed

(57) ABSTRACT

A modular display case having a chamber for holding an item to be displayed, such as a folded flag, as well as a chamber for housing an illuminating LED strip within the base of the case. The case is made from multiple layers of material spaced apart with ring spacers between the front panel and back panel which are connected with fasteners. The front panel of the case is removably attached to the body of the case and is seated within a tray in the integrated base. The item held in the display chamber is visible through slats between the layers as well as through the viewing windows on the front and rear panels of the case. The rear panel of the case is generally solid whereas the front panel is removably attached to the body of the case and thereby permits access to the display chamber.

20 Claims, 11 Drawing Sheets

(56) References Cited

U.S. PATENT DOCUMENTS

| | | | | |
|---|---|---|---|---|
| 7,591,097 | B2 | 9/2009 | Alman | |
| 9,284,745 | B2 | 3/2016 | Marco | |
| D806,449 | S | 1/2018 | Pennington | |
| 2005/0172532 | A1* | 8/2005 | Yiu | A47F 3/001 40/714 |
| 2007/0204500 | A1* | 9/2007 | Splittgerber | A47G 1/06 40/781 |
| 2007/0273253 | A1 | 11/2007 | Fair | |
| 2009/0019752 | A1* | 1/2009 | Liao | G09F 13/04 40/714 |

OTHER PUBLICATIONS

Living Patriot, LLC, Shop [online], Apr. 6, 2017. Retrieved from the Internet: <www.livingpatriot.com/store/>.

* cited by examiner 10
12
14
16
18
18
28
48
50

20
20
12
14
16
22
22
34
72
70
$s_t$
$d_w$ 46
44
48
40

66
68
$s_w$
54
24
42
32

MODULAR DISPLAY CASE

CROSS-REFERENCE TO RELATED APPLICATIONS

This application claims priority from U.S. Provisional Patent Application No. 62/729,734 filed on Sep. 11, 2018.

STATEMENT REGARDING FEDERALLY SPONSORED RESEARCH

Not Applicable.

APPENDIX

Not Applicable.

BACKGROUND OF THE INVENTION

Field of the Invention

The present invention relates to display cases, and more particularly to modular illuminated display cases for memorabilia.

Related Art

Display cases have long been used for displaying memorabilia and similar items in homes, offices, and in public spaces. Most display cases include a single chamber that houses the item and a glass or otherwise transparent viewing window through which the item can be viewed while also being somewhat protected. Cases have also been particularly sized and shaped to accommodate specific items, for example a folded flag.

Displays may also be illuminated in many different fashions but are often times illuminated by room light or external attached light fixtures. However, this practice results in undesirable lighting within the frame. Prior attempts to improve frame lighting have moved the light sources within the display. Interior display lighting presents difficulties in hiding the light source, distributing the light evenly, and connecting a power supply to the light source. As one solution, the display in U.S. Pat. No. 7,080,918 by Grant describes an integrated LED light source in a compartment below the display compartment that is hidden by a divider that is light impermeable and has an aperture to let some light into the display compartment. The Grant '918 Patent is similar to many other display cases in which a front face is mechanically attached to one of the sides of the display case through a hinge so that the front can open to place items into the display chamber, but the front cannot be entirely removed from the sides of the display case without disassembling the hinges that hold the front to the display case. Additionally, the Grant '918 Patent uses a standard form to produce the display case with solid sides in which the width of the sides define the depth of the display case.

The original Living Patriot® display case had created a new type of modular prismatic display case in which multiple frames, as generally shown in FIG. 1, were fastened together to form a display chamber. The prismatic display case had been formed separate from a base on which the prismatic display case could be seated. The base housed a light beneath a diffuser panel, and when the prismatic display case was seated on the base, the light would illuminate the display chamber. The front panel of the prismatic display case had been connected to the inner panels with the same screw fasteners that connected the inner panels with the back panel and hold the prismatic display case together. The screws that extend through the front panel would have to be removed from the screw post in order to remove the front panel and get access the display compartment for placing or removing an item therein. Accordingly, even with the known prismatic display case in which the display chamber is formed by the frame panel sections, there had remained a desire for improving the display case to improve the manufacturability of the display case and to simplify the access to the display chamber while avoiding hinges or other mounts between the front panel and sides.

SUMMARY OF THE INVENTION

The present invention is a modular display case having a chamber for holding an item to be displayed, such as a folded flag, as well as a chamber for housing an illuminating strip within the base of the modular case. The case preferably has a prismatic shape made from multiple A-shaped acrylic inner frame panels separated by spacers and connected together with a rear panel by sets of fasteners, and a front panel can be placed over and removably connected to the outermost inner frame panel. The preferred fastener is a post and screw that extends from its permanent connection on the rear panel of the case through holes within each layer of the case. Additionally the head of the fastener opposite from the rear panel removably engages a magnet connected to the removable front panel. Accordingly, the magnets engage the ferrous head of the post and hold the front face onto the display.

The item held in the display chamber is visible through slats between the inner frame panels as well as through the viewing windows on the front and rear panels of the case. The rear panel of the case is generally attached to the interior layers of the case by the fasteners whereas the front panel is removably attached to the rest of the body and thereby permits quick and easy access to the display chamber. Additionally, the preferred embodiment has a top section that is made from a clear acrylic or otherwise transparent material allowing each portion of the item within the display chamber to be visible.

Another aspect of the invention is an integrated base portion comprised of the bottom side of the inner panels and another set of spacers below the upper portion of the A-shaped case. The front panel also has a separate base portion detached from the triangular upper section where the bottom edge of the lid portion of the panel is seated against the top edge of the base portion. Additionally, a front cover connects to the base and they collectively provide a lip and tray to further support the front lid panel.

In another aspect of the case, a chamber for housing an LED light strip to illuminate the display chamber is positioned within a cutout in the bottom side of the inner panels. To allow light to pass into the display chamber, a top light diffuser plate forms the top of the chamber and another light diffuser forms the bottom of the chamber. Accordingly, the LED strip illuminates the item within the display chamber above through the top diffuser as well as provides an under-glow beneath the entire unit through the bottom diffuser. Further, the slats between the inner panels allow light to escape and better illuminate the item held within the display chamber.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings as summarized below.

DETAILED DESCRIPTION OF THE PREFERRED EMBODIMENTS

Figure 1:
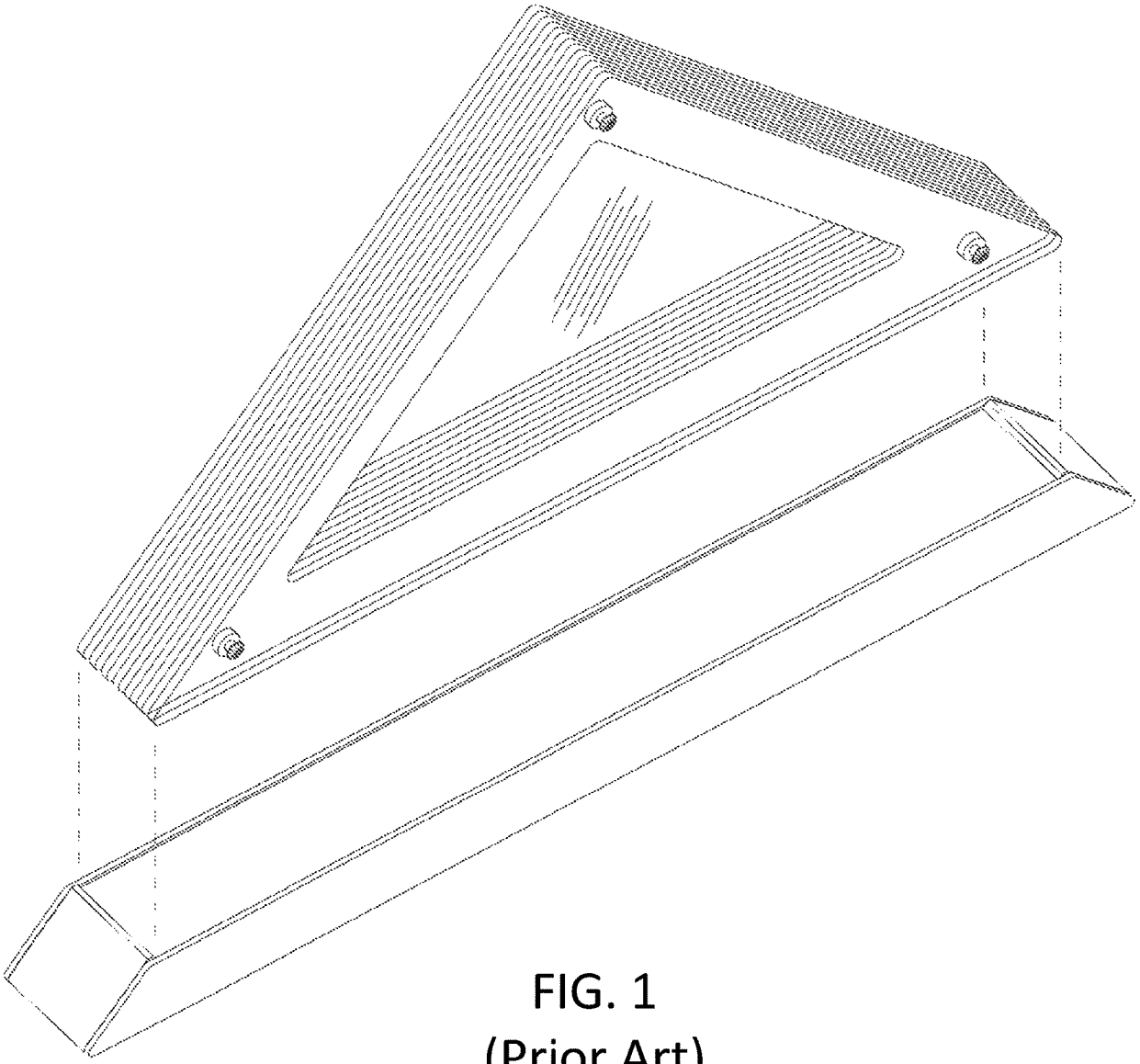
FIG. 1 (Prior Art)
FIG. 1 is an isometric view of a prior art display case.

The following description of the preferred embodiment(s) is merely exemplary in nature and is in no way intended to limit the invention, its application, or uses.

As generally shown in the accompanying drawings for the various embodiments of the present invention, a modular display case 10 is formed from multiple flat panels 12, 14, 16 that are fastened together. A front panel 16 is secured to an outermost inner panel 14 through a set of releasable fasteners 18, and the inner panels are connected to each other and to the rear panel 12 through a set of mechanical fasteners 20. Preferably, the mechanical fasteners also connect spacers 22 between the inner panels. The inner panels 14 have an upper portion 38 and a base portion 40, and the panels in the base portion are fastened together with a front base panel 28 and a rear base panel 30 to form the base support 42 of the display case.

As described below with reference to FIGS. 2-5, the upper portion of the inner panels can be formed with side sections 44 that together with the base portion form a frame 46 that encloses an interior space 48 and which together form a display chamber 50. Alternatively, as described below with reference to FIG. 6, the upper portion can be formed by different interior shapes or designs 52*a*', 52*a*", 52*b*, 52*c* that extend from the base portion of the inner panels and can be enclosed by a frame 46 but are not necessarily enclosed. Preferably, in each version of the display case 10, the base portion of the inner panels has a cutout section 54 and together they form a base chamber 56 that and holds a light 24 and a diffuser panel 32 above a bottom edge 98 of each inner panel. The diffuser panel is preferably translucent and is positioned between the light and the upper side 100 of the cutout section. Sections of the bottom edge can be raised to provide a space underneath the display case where the light shines out onto the surface on which the display case is seated.

The light is preferably a light panel assembly that has one or more strips of LEDs 24*a* mounted to a flat board 24*b* and is seated on the lower side 102 inner panels' cutout section, i.e., the bottom of the base chamber. The flat board preferably matches the shape of the base chamber, and the LEDs are spaced out along the length and width of the board to help evenly distribute the light to the display chamber. As particularly shown in FIG. 2J, a single strip of LEDs has a pair of long LED sections connected by a short LED section. In the preferred embodiments, the panels are transparent and have a prismatic shape so when the light enters the bottom of the panels, it is refracted and directed to the upper portions where it impinges on the edges of the panels and illuminates the item within the interior of the display chamber while also providing an edge lighting glow effect around the exterior side of the panels. The spacers between the inner panels create open slats or spaces through which ambient air can circulate and dissipate the heat generated by the light. Additionally, the raised floor below the base chamber between the rear and front panels provides a bottom space underneath the light panel for the ambient air to flow and provide a natural convection for additional heat dissipation from the light panel.

Figures 2A, 2B, 2C, 2D:
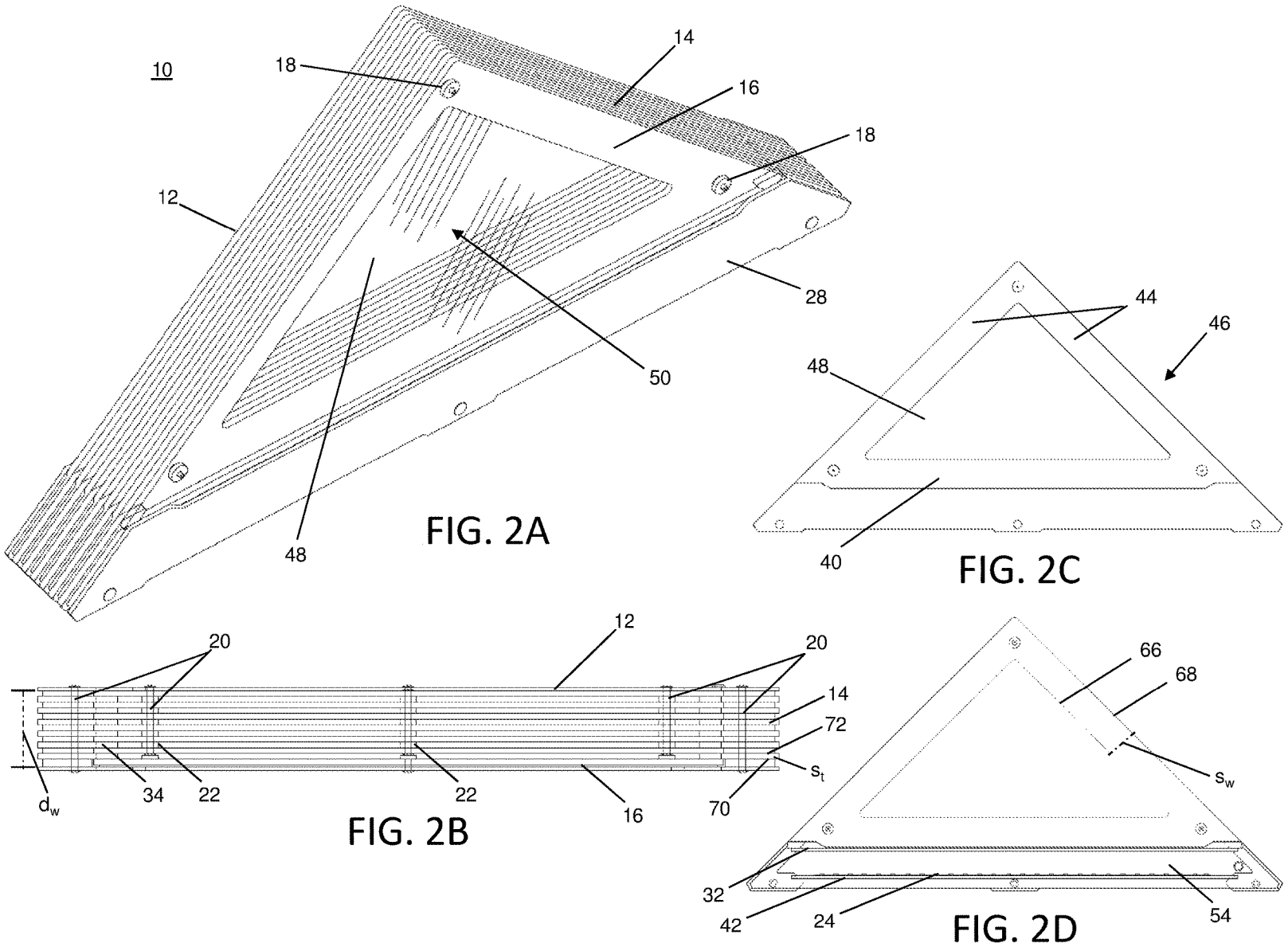
FIG. 2A shows a perspective view of a first embodiment of the modular display case according to the present invention.
FIG. 2B shows a top view of the first embodiment.
FIGS. 2C and 2D show a front view and front cross sectional view, respectively, of the first embodiment.
Figure 2F:
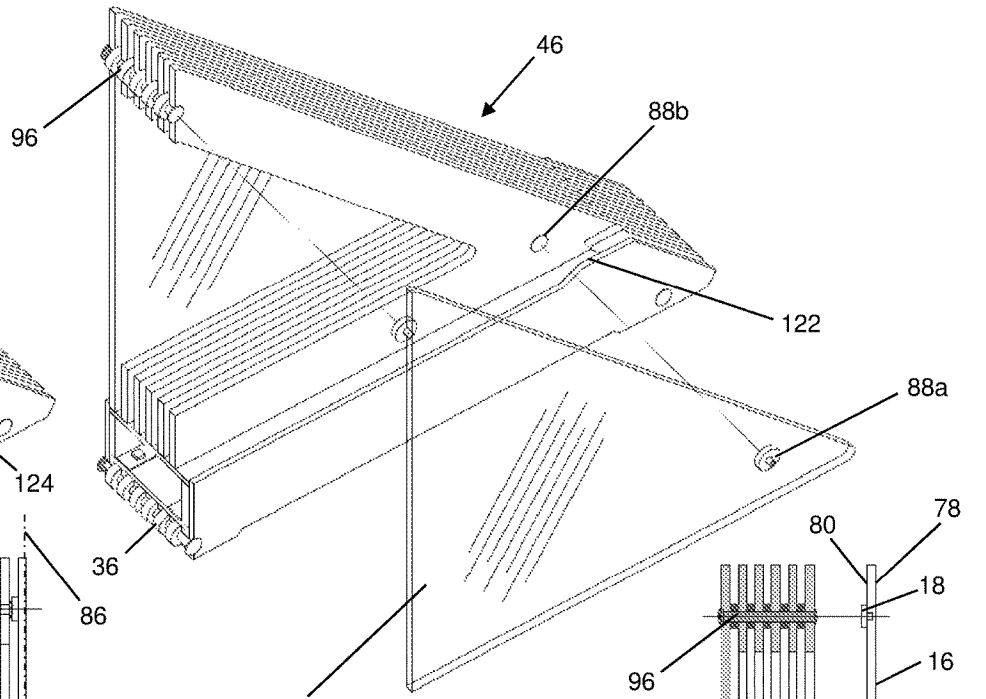
FIGS. 2E and 2F show a cross sectional perspective view of the first embodiment with a front panel connected to the display case and the front panel removed from the display case, respectively.
Figure 2H:
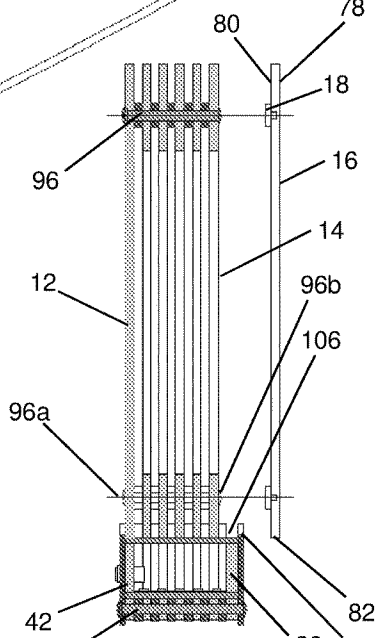
FIGS. 2G and 2H respectively show the first embodiment in a side view with the front panel connected to the display case and a cross sectional side view with the front panel removed from the display case.
Figure 2G:
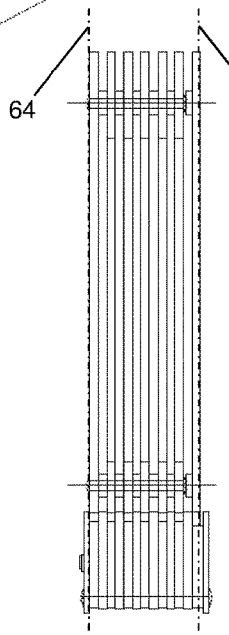
Figure 2E:
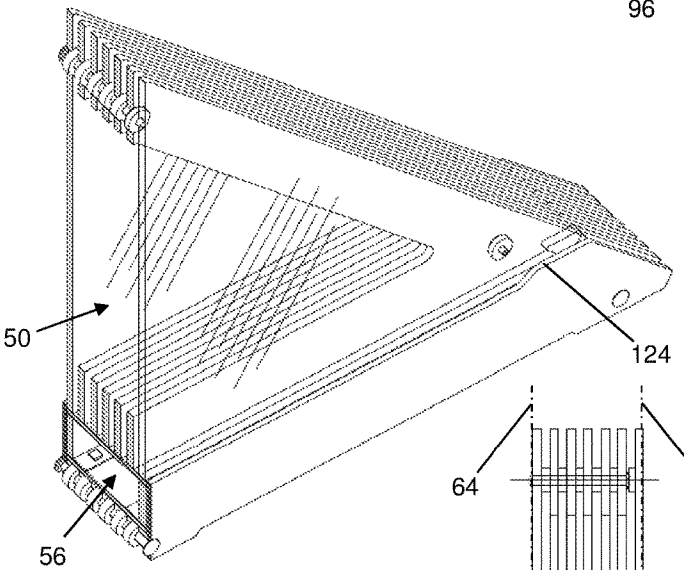

Preferably, the releasable fasteners are magnetic fasteners 88 that are attached to corresponding corners of the front panel and the outermost inner panel. It will be appreciated that any type of releasable fastener can be used to releasably connect the front panel to the display case. For example, in place of magnetic fasteners, hook and loop fasteners, clasp fasteners, or snap fasteners could be used. Accordingly, the front panel has an engaged position as shown in FIGS. 2E and 2G in which it is connected to the display case through the engagement of the releasable fasteners and a disengaged position as shown in FIGS. 2F and 2H in which it is spaced free from the display case when the releasable fasteners are disengaged from each other. When the front panel is in the engaged position, it is situated in a plane 86 parallel to the longitudinal plane 64 of the rear panel. When the front panel is off of the display case, the display chamber is open to receive the item that is to be held within the display chamber.

The display cases 10 shown in FIGS. 2-5 include the rear panel 12 and the front panel 16 and also preferably include a base chamber cover 26 that is situated between the front base panel 28 and the outermost inner panel 14. The rear panel and the front panel respectively enclose the back and front of the corresponding display chambers that are formed by the frame 46 of the inner panels 14. In these embodiments, the base portion 40 extends between the side sections 44, and the frame section preferably has an identical shape 46*a* for each one of the inner panels 14*a*. In comparison, for the display case 10 shown in FIG. 6, the inner panels 14*b* can have different shapes. In each one of the embodiments, the width ($s_w$) of the side sections between the interior edge 66 and the exterior edge 68 is greater than a thickness ($s_t$) of the side sections between the forward face 70 and the rearward face 72 ($s_w > s_t$). For the display cases in which the inner panels 14 have a frame section, each inner panel has a periphery shape 74 that substantially matches and is aligned with the outer periphery 62 of the rear panel, and the forward face and the rearward face are each situated in a plane 86 parallel to the longitudinal plane 64 of the rear panel. By adding more inner panels and more spacers 22, the width ($d_w$) of the display chamber between the rear panel and the front panel can be greater than the width of the inner panel's side sections ($d_w > s_w$).

The rear panel 12 has a rear face 58 and a forward facing inner surface 60. The rear panel and each one of the inner panels have a plurality of apertures 90. The apertures in the rear panel are located proximate to the rear panel's outer periphery 62, preferably in the corner regions of the panels, and the apertures in the inner panels are respectively aligned with the apertures in the rear panel along a set of lateral axes 92 that are substantially perpendicular to the longitudinal plane of the rear panel. The spacers 22 each have an aperture 94 and are positioned between adjacent pair of inner panels, and the spacers between the upper portions of the inner panel are preferably transparent and circular. The axes extend through the apertures of the respective spacers, and the mechanical fasteners extend along the axes through the apertures of the inner panels and the spacers.

The rear panel preferably includes an upper slit 116 and a lower slit 118 that are respectively aligned with the upper side 100 and the lower side 102 of the inner panel's cutout section which are substantially aligned with the bottom edge. The base chamber cover 26 also preferably includes a slit 120 that is aligned with the lower side of the cutout section. Opposite longitudinal sides 24*c* of the light panel's support board 24*b* extend into the lower slit in the rear panel and the slit in the base chamber cover, and a longitudinal side 32*a* of the diffuser panel extends into the upper slit in the rear panel. The base portion in each one of the inner panels has a pair of recesses 114 on opposite sides of the cutout section proximate to the upper side, and opposite lateral ends of the diffuser panel respectively extend into the pair of recesses.

As indicated above, the front panel 16 is spaced from the rear panel 12 by one or more inner panels 14 and preferably also spacers 22. The front panel has a front face 78 that is the outer front surface of the display case and a rearward facing inner surface 80 that faces toward the display chamber. The front panel's bottom side 82 is seated on a top edge 106 of the base chamber cover 26. The front panel's upper periphery 84 substantially matches and is aligned with the periphery shape 74 of the inner panel side sections 44. At least a portion of the upper edge 122 of the front base panel 28 extends beyond the top edge of the base chamber cover and forms a lip 124 or wall adjacent to the bottom side of the front panel. Together with the upper edge of the front base panel and the base portion of the outermost inner panel, the lip forms a channel that holds the front panel's bottom side. The lip does not need to extend along the entire front panel; as particularly shown in FIGS. 2A and 2E-2H, a pair of lip segments are located on opposite ends of the front base panel.

Figure 2I:
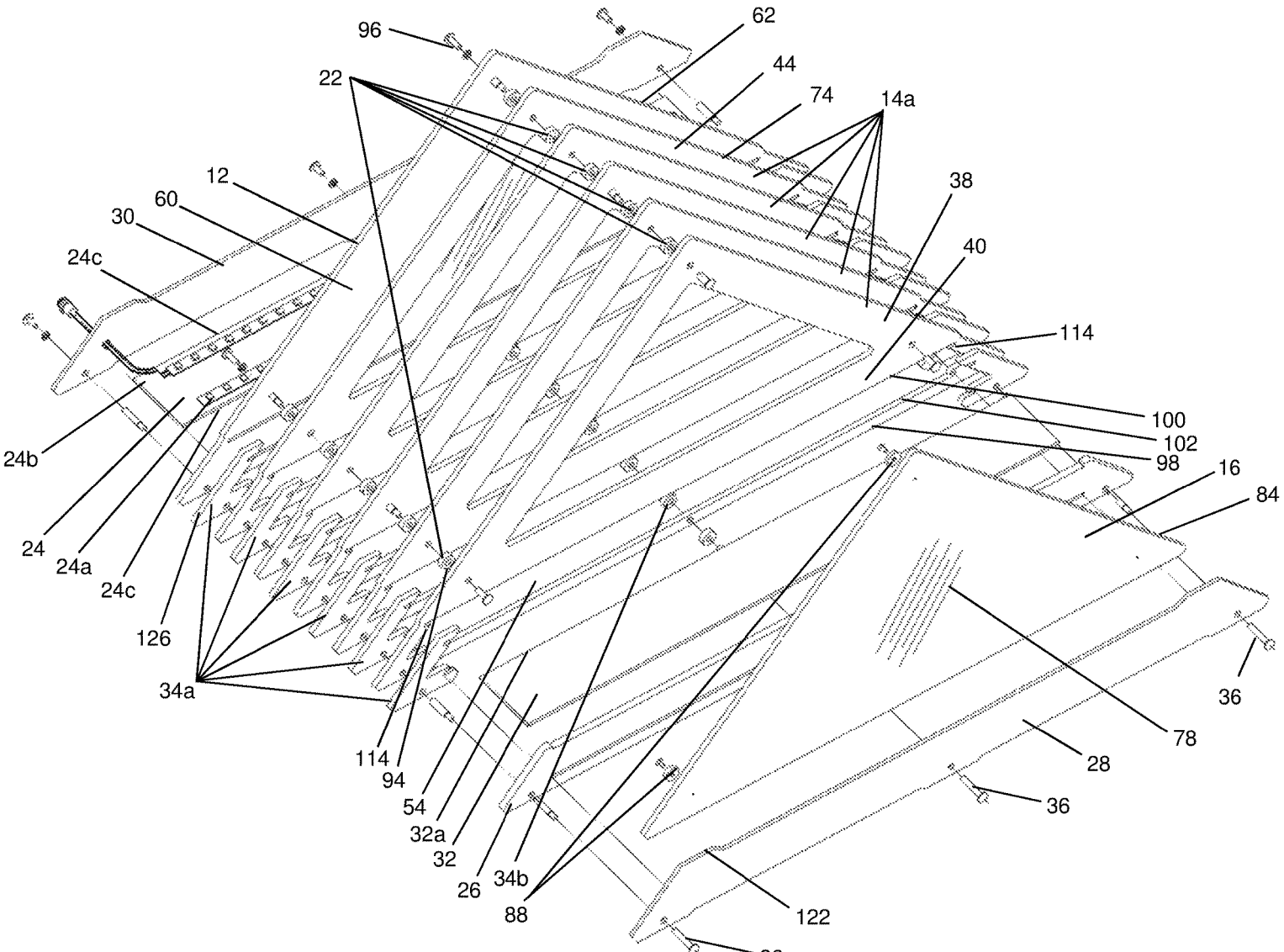
FIGS. 2I and 2J respectively show front and back exploded isometric views of the first embodiment.
Figure 2J:
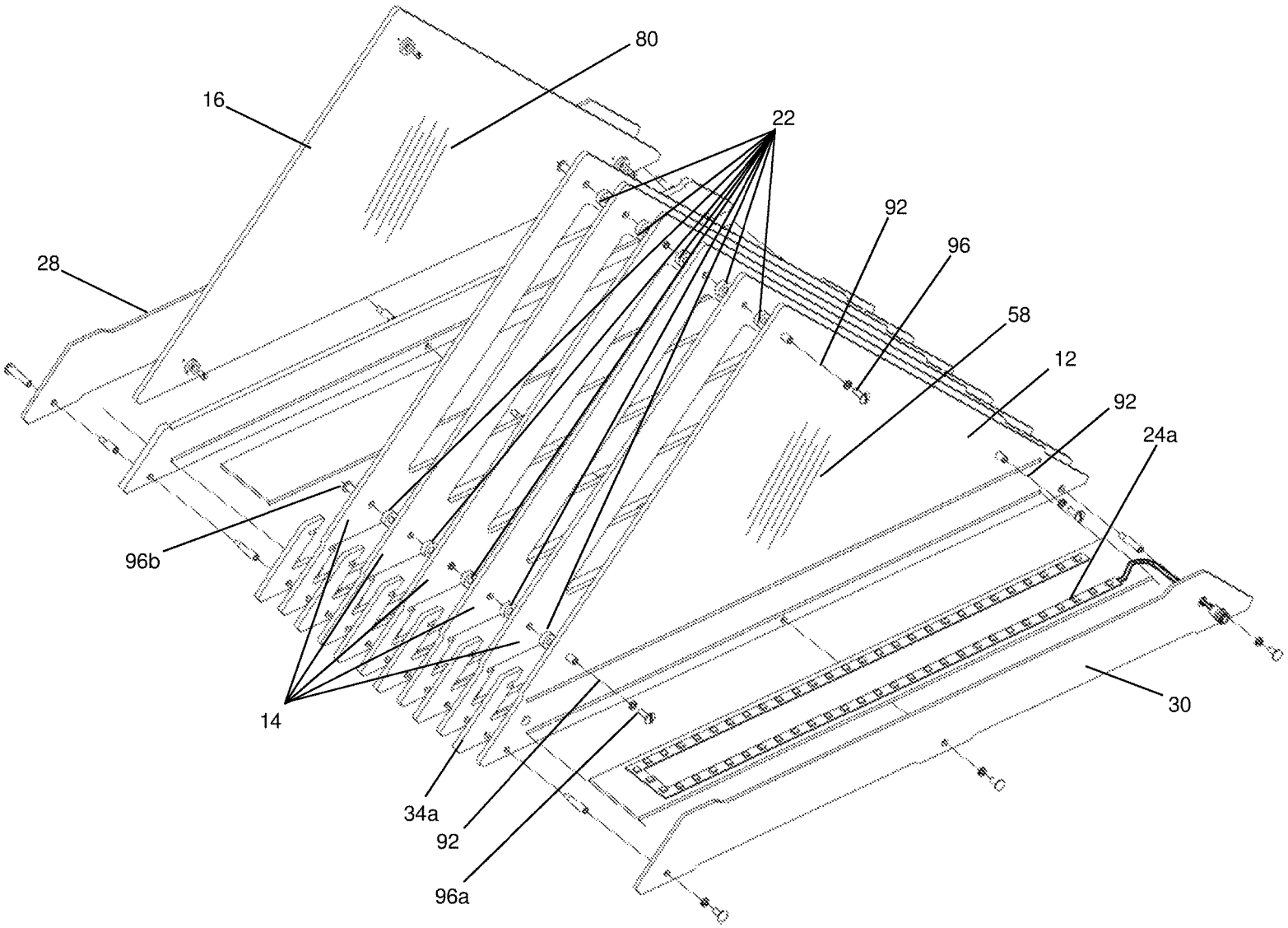
Figure 3A:
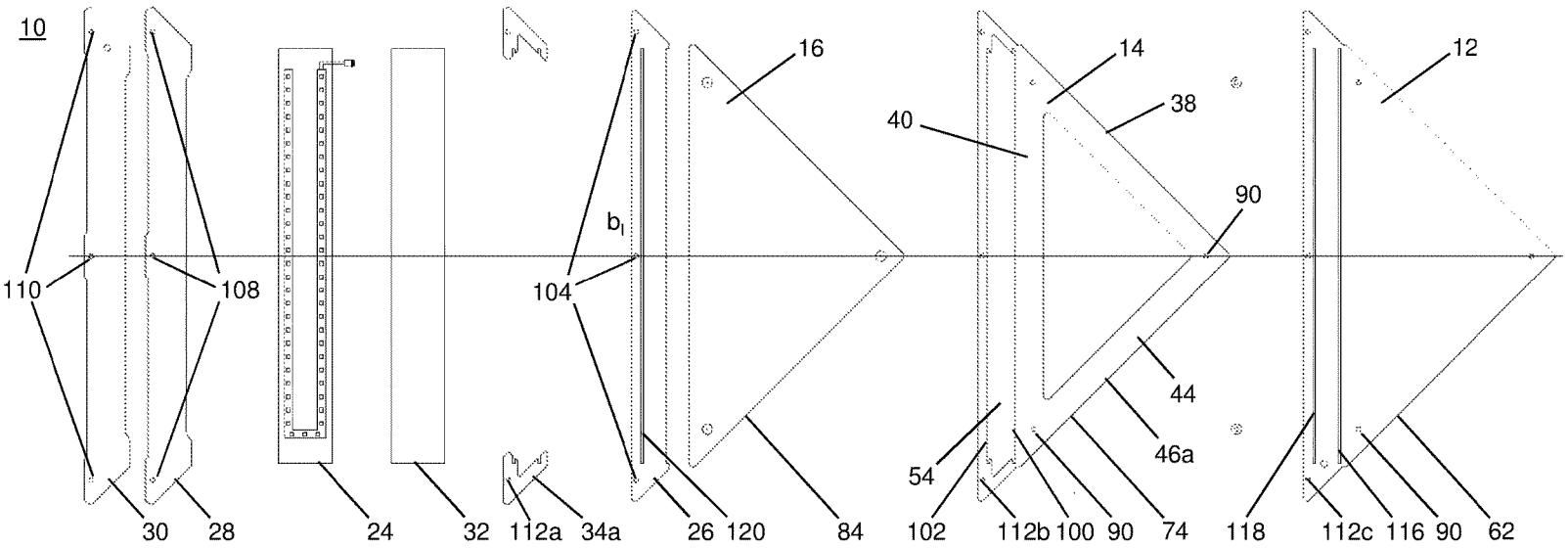
FIGS. 3A and 3B respectively show a plan view and an isometric view of the parts in the first embodiment.
Figure 3B:
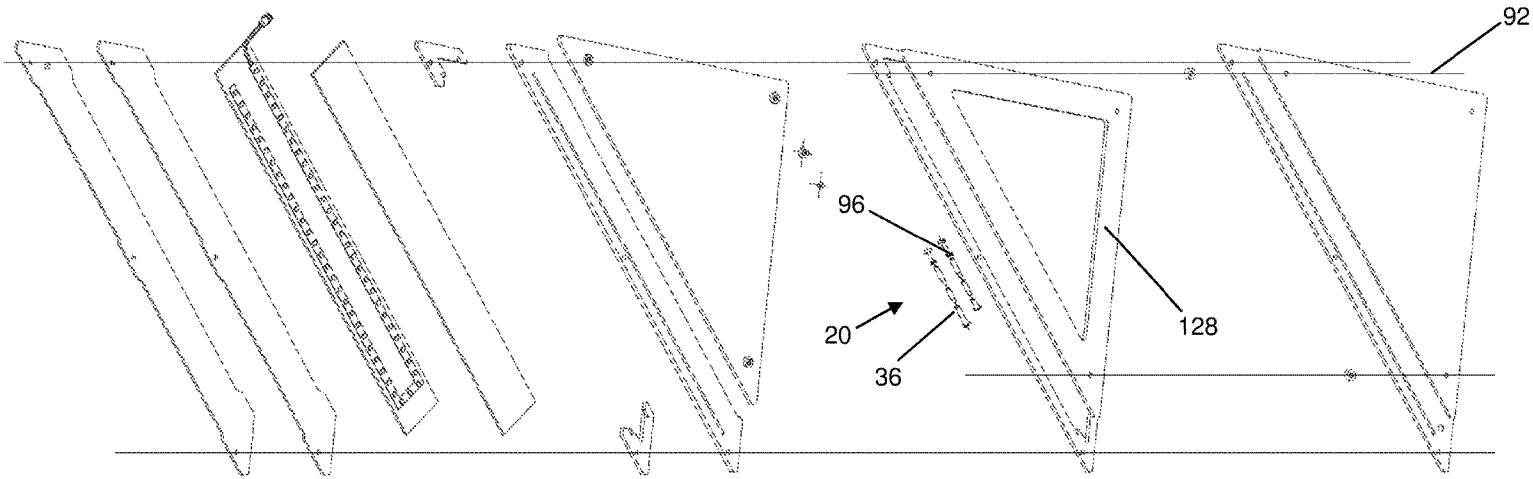

As shown in FIGS. 2I, 2J, and 3B, the mechanical fasteners 20 preferably have screw extension posts that extend through the apertures in the rear panels, the inner panels, and the spacers. The posts have threaded ends on which screw heads 96 are mounted, with one head 96*a* engaging the rear face of the rear panel and the other head 96*b* engaging the forward face of the outermost inner panel. Preferably, one end of the screw extension post is externally threaded and the other end is internally threaded. Multiple screw extension posts can be screwed together to accommodate additional inner panels that increase the width of the display cases. Lock washers may also be used with the mechanical fasteners, such as between the head of a screw and the rear face of the rear panel. The screw head engaging the front face of the outermost inner panel is a terminal end of the fastener that is preferably formed from a magnetically attractive material. Countersunk ring magnets are preferably attached to the rearward facing inner surface of the front panel at the corners opposite from the magnetically attractive screw heads at the front face of the inner panel. The ring magnets engage with the magnetically attractive screw heads to hold the front panel to the inner panel. It will be appreciated that the other types of mechanical fasteners could be used in place of the screw fasteners, or in combination with screw fasteners, such as layers of adhesive materials, hook and loop fasteners, and friction fit dowels.

For the magnetic fasteners 88, magnets 88*a* can be fastened to either the rearward facing inner surface proximate to the front panel upper periphery or the forward face of the inner panel side sections, and magnetically attractive material segments 88*b* are fastened opposite from the plurality of magnets to the corresponding section of the inner panel side sections or the rearward facing inner surface. For display cases that have lip segments on the front base panel, it is not as important to have magnetic fasteners at the bottom side of the front panel because when the front panel's bottom side is fit into the channel formed by the lip segments, it will not slide off of the front base panel. Accordingly, magnetic fasteners or some other type of releasable fastener are more important for the top side of the front panel.

The base chamber cover 26 has a plurality of apertures 104 spaced along its length (bi), and the base chamber cover is positioned adjacent to the base chamber. The front base panel 28 is positioned adjacent to the base chamber cover and has a plurality of apertures 108 aligned with the apertures in the base chamber cover. The rear base panel 30 is positioned adjacent to the rear face of the rear panel proximate to the base chamber and has a plurality of apertures 110 aligned with the apertures in the base chamber cover. Additional spacers 34 preferably fit between adjacent pairs of inner panels 14 at their base portion 40 and the rear panel 12, and each respectively has apertures 112*a*, 112*b*, 112*c* aligned with the apertures in the base chamber cover. Mechanical fasteners 36 extend through the apertures and connect the rear base panel, the base portions of the rear panel and the inner panels, the base chamber cover, and the front base panel.

The spacers 34*a* proximate to the lateral sides of the inner panels preferably have a pair of adjacent sides 126 with a shape that matches the periphery shape of the inner panels at the side sections proximate to the base portion. Depending on the size of the display case, additional circular spacers 34*b* may be secured with fasteners between the inner panels in the bottom center section of the base portion. It will be appreciated that the spacers between the inner panels are not necessary, and the inner panels can be positioned against each other and against the rear and front panels. When used, the spacers create open spaces within sidewalls of the display which allows air to ventilate the display chamber and the item being displayed as well as providing a side view of the item.

Figure 4A:
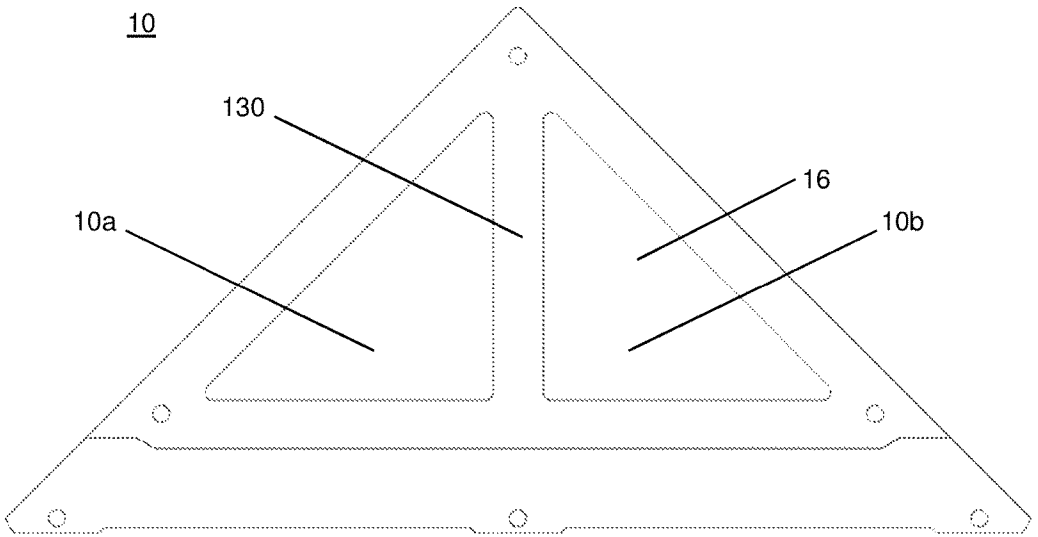
FIG. 4A shows a front view of a second embodiment of the modular display case according to the present invention.
Figure 4B:
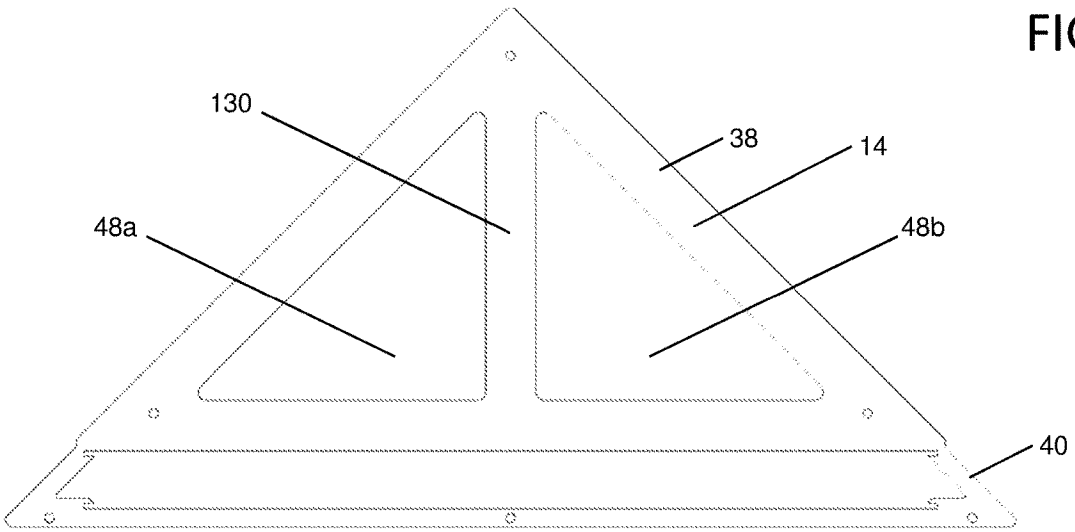
FIG. 4B shows a front view of an inner panel for the second embodiment.
Figure 5A:
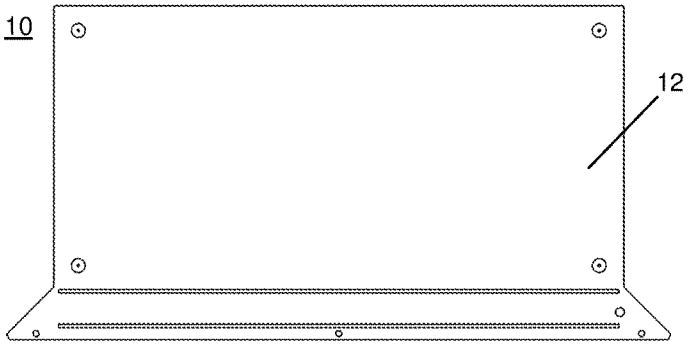
FIGS. 5A-5C show a rear panel, an inner panel, and a front panel, respectively, for a third embodiment of the modular display case according to the present invention.
Figure 5B:
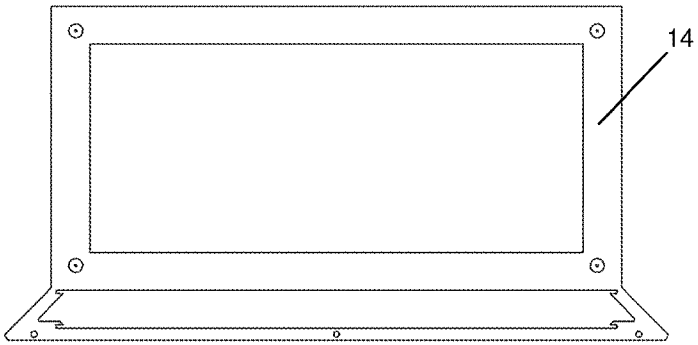
Figure 5C:
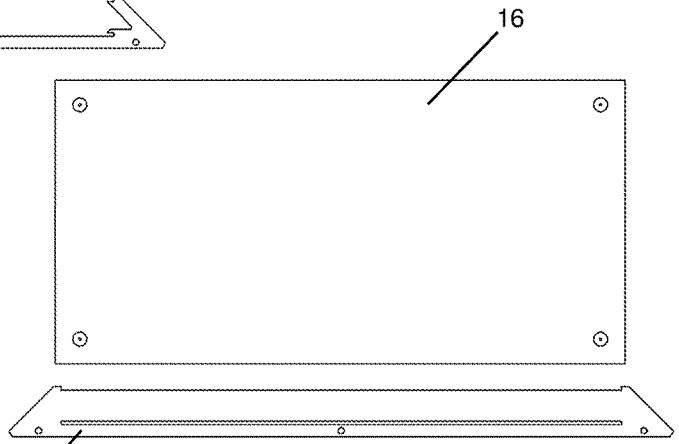
Figure 6C:
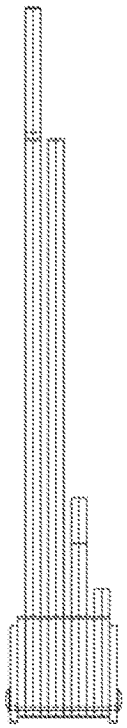
FIGS. 6A-6F show a fourth embodiment of the modular display case according to the present invention.
Figure 6B:
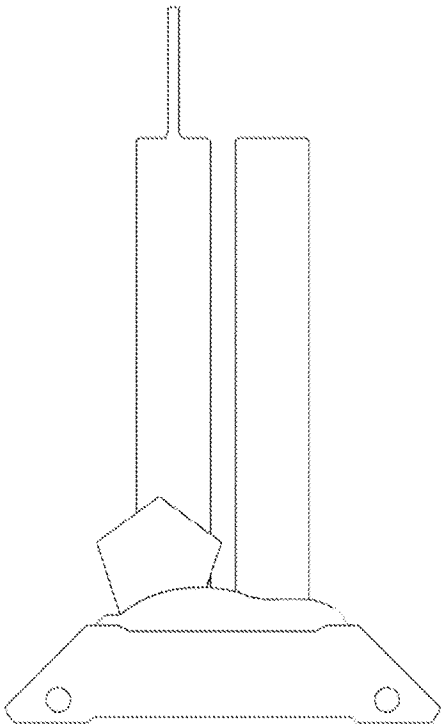
Figure 6D:
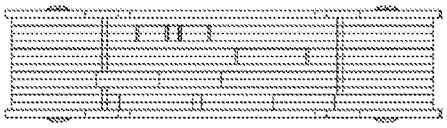
Figure 6A:
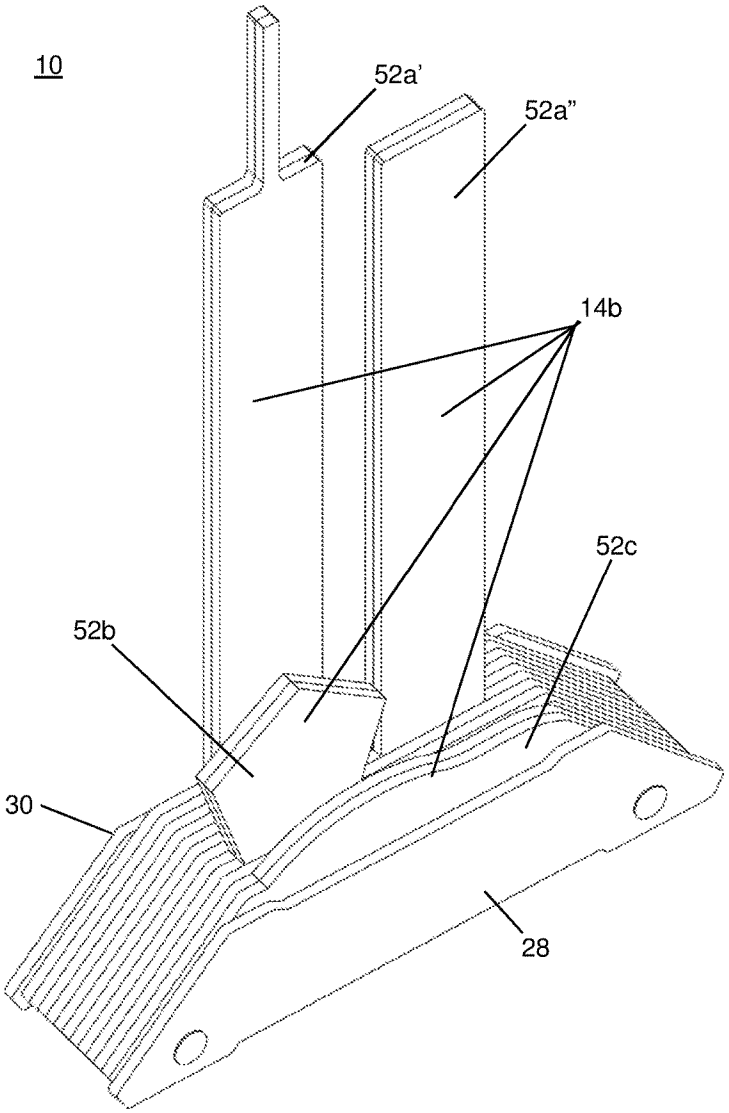
Figure 6F:
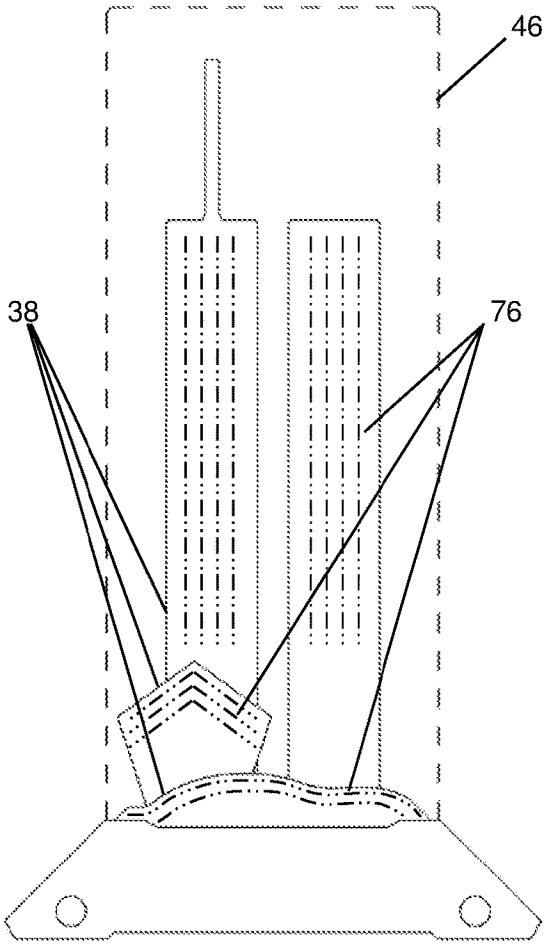
Figure 6E:
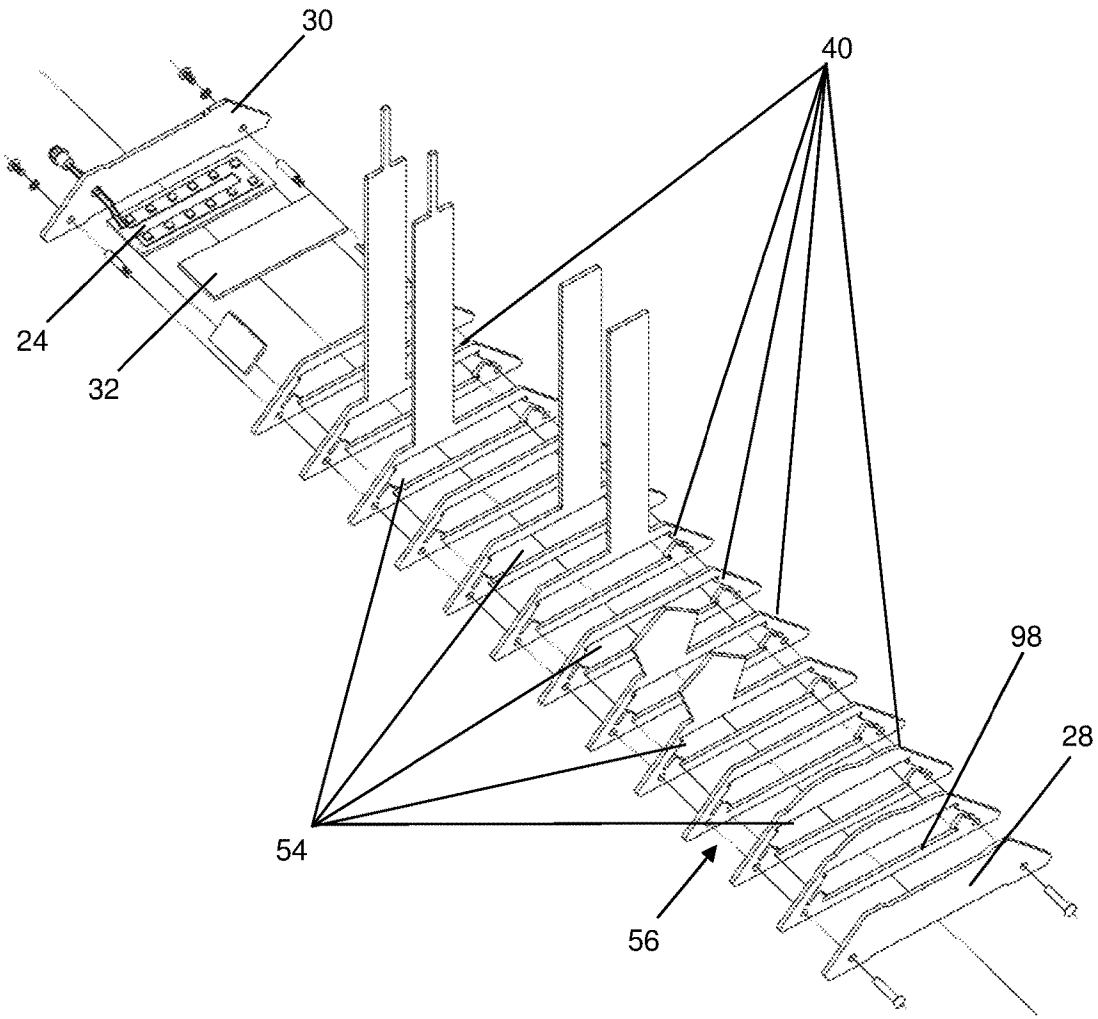

The shape of the display case can vary. For example, the embodiments shown in FIGS. 2-4 are triangular, and the embodiment shown in FIG. 5 is rectangular. The embodiment shown in FIGS. 6A-6F has an irregular shape according to the different shapes of the inner panels' upper portions, although this embodiment could have an outer periphery shape with a frame of inner panels as particularly shown in FIG. 6F and may also have a front panel and rear panel with a matching shape. As shown in FIGS. 4A and 4B, the display chamber 10 can have multiple display chamber sections 10*a*, 10*b* in the upper portion. To create multiple chamber sections, one or more internal segments 130 extend between the side sections and/or from the side sections to the base portion. In the particular embodiment shown in FIG. 4B, a central vertical internal segment divides the inner panels 14 into interior space sections 48*a*, 48*b* that form the display chamber sections.

The inner panels, the front panel, and the back panel are preferably made from transparent acrylate polymers or other transparent plastic materials, but the panels can be made from any number of materials that may be transparent, translucent, or opaque, including without limitation metal, wood, composites, china, ceramics, and glass. Since the display case according to the present invention is modular, panels made from different materials and/or different colors can be used together. For example, a display case for a "Thin Blue Line" American flag representing law enforcement may include one or more blue panels. Similarly, a display case for a "Thin Red Line" American flag representing firefighters may include one or more red panels. Other colors, designs and materials may be used or combined to create custom display cases using the modular panels according to the present invention.

Preferably, the side sections and base portion of the inner panels are formed from a single piece of transparent plastic material 128 whereas the front base panel, the rear base panel, and the lateral side spacers are preferably opaque. The opaque front and rear base panels conceal the light in the base chamber beneath the diffuser panel and also conceal the slits in the rear panel and the base chamber cover. The panels that form the display case can include various designs, graphics, messages, or other indicia that may particularly relate to the item to be displayed. The panel indicia can be produced by any means that is presently known or may be developed in the future for various types of materials, such as laser engraving, laser marking, silk screen printing, or applied vinyl cut graphics. For example, one of the front or rear panels may include a congratulatory message for a retiring officer who is gifted a display case holding a flag. Similarly, a name and date with other information or message can be included on the front or rear panel should a display case be used to display the memorial flag of a US armed forces veteran.

The removable front panel allows for different front panels with different indicia to be produced separate from the other panels that form the display case which makes customization of the display case much easier than cases in which the front panel is mechanically attached to one or more of the sides of the display case. For example, the releasable front panel also allows a person to buy the display chamber without a front panel or with a generic front panel, and without having to transport the entire display panel, the owner can then have the generic front panel modified with customized indicia or the owner can swap out the generic front panel with a customized front panel. The display chamber can hold any type of memorabilia or item that a person may want to display, such as coins, medals, ribbons, awards, souvenirs, and letters or other documents, and the interior shape of one or more of the inner panels can be formed as a stand or other support on which the item can be placed within the display chamber.

It will be appreciated that some display cases may not have a base chamber or a light below the display chamber. Additionally, for some display cases, the front and rear base panels would not be necessary even though there is a light in the base chamber. For example, it is possible for an opaque film to be placed over the bottom side of the rear panel and the base chamber cover to conceal the light panel in the base chamber beneath the diffuser panel. It is also possible for the front panel to extend all the way down to the bottom of the display case like the rear panel and still be connected to the outermost inner panel with a releasable fastener. Such a front panel could also have an opaque film adhered to its bottom side to conceal the light panel in the base chamber so that the base chamber cover is not needed.

For the embodiment shown in FIGS. 6A-6F, the base portion 40 of the inner panels 14 have a cutout section 54 and a bottom edge 98 as in the other embodiments described above, but the upper portions 38 of the inner panels have different shapes in this embodiment as compared to inner panel with the same shape in the other embodiments. A set of flat, machine-cut shapes are stacked and fastened together using male-female screw posts to create the display with the light panel in the base chamber below the display. In the particular embodiment, the upper portions are cut in shapes that represent the places involved in the 911 terrorist attacks, including the World Trade Center towers in New York, N.Y., the Pentagon in Washington, D.C., and the field in Shanksville, Pa. As a tribute to the victims of the 911 terrorist attacks, the names of the victims are preferably laser engraved into the upper portions corresponding with the places where they perished. It will be appreciated that other shapes could be formed in the inner panels for any type of tribute, memorial, or other commemorative display. The front panel, back panel, and inner panels can include an outer periphery shape that provides a frame for the upper portion shapes in the inner panels, such as the rectangular frame 46 shown in FIG. 6F.

Within the base chamber, the translucent layers of acrylic receive the light from the LED light strips on the light panel and direct the light into the upper portions of the inner panels to the edges of the panel which are illuminated by the light. This edge lighting of the upper portions results in a glowing appearance to the shapes. Additionally, text, graphics, and any other indicia can be laser engraved or otherwise etched into the surface of the upper portions; the etched indicia 76 also catch the light and are illuminated with a glowing appearance. The front and back panels preferably include a center section in which the bottom edge is slightly raised off of the surface on which the display case is seated which provides a space underneath the display case that allows the light to shine out onto surface.

Figure 7:
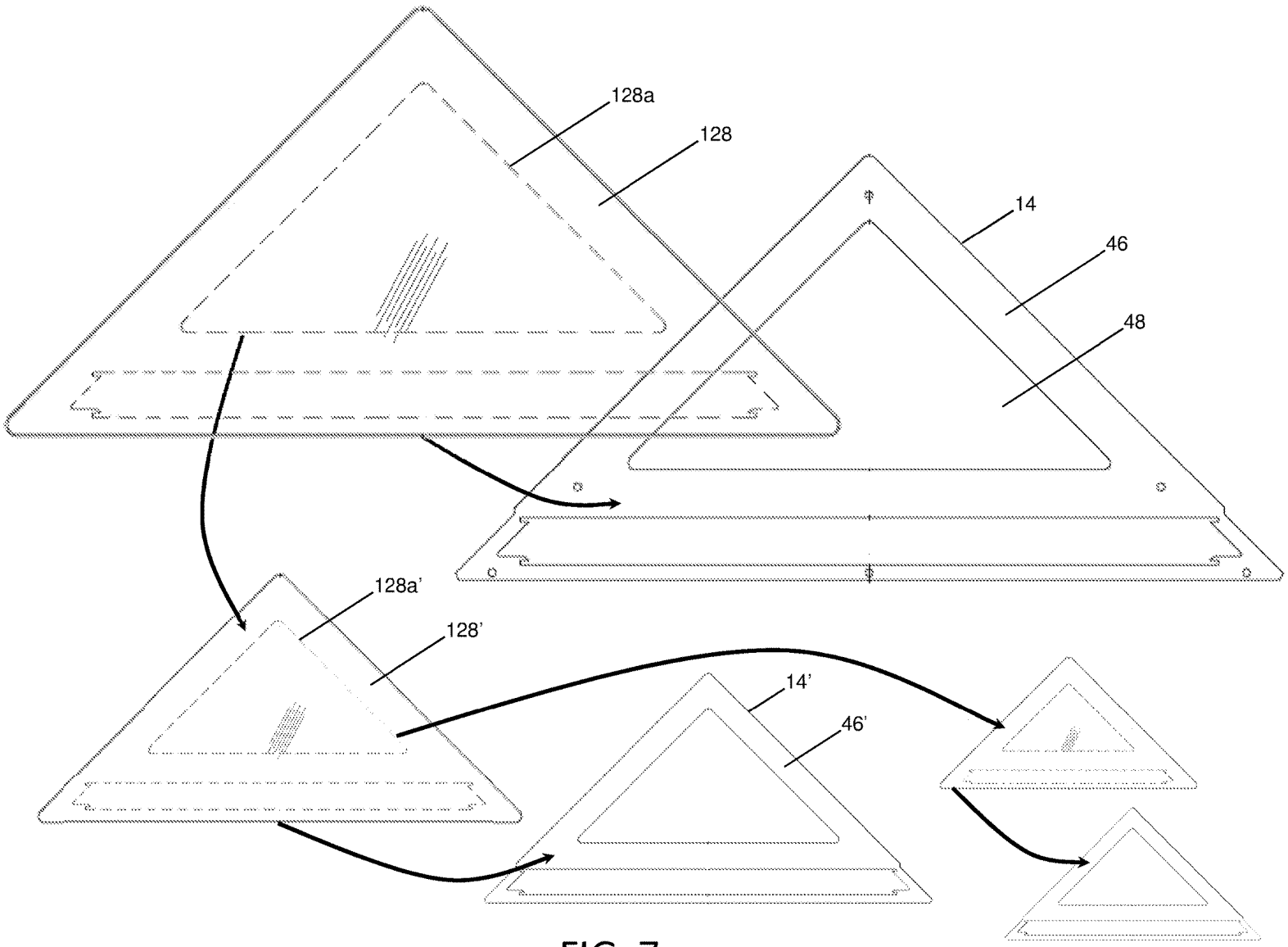
FIG. 7 is a schematic representation of the manufacturing process in which cutout sections from a larger case are used as the sheets of material for smaller cases.

In manufacturing the display case, it is an aspect of the invention to create the separate planar sheets which are modularly assembled into the three-dimensional display case as described above. It is also an aspect of the manufacturing method in making the display case described herein to use most of the materials in a single sheet of material from which the multiple panels described herein are cut. For example, as shown in FIG. 7, the section of the sheet that is cut from each inner panel to form the space in the inner panel has the same general shape as the case. Generally, the frame 46 of the inner panels is formed from a solid panel 128 with an internal region 128*a* removed to produce the interior space 48 within the frame. The internal region has a second shape that is a scaled-down copy 128' of the first shape, and a scaled-down internal region 128*a*' is removed from the internal region to form a scaled-down frame 46'. The scaled-down frame forms scaled-down inner panels 14' for a scaled-down version of the display case. Accordingly, these cutout sheet sections that are removed from the inner panels to form the space are preferably used as the sheets of material for a smaller display case. Naturally, the outer periphery of the smaller case is slightly smaller than the dimensions of the space in the inner panel from which the cutout sections have been taken. It will also be appreciated that the cutout sections from the smaller case could similarly be used as the sheets for making an even smaller display case. Accordingly, by producing multiple display cases of different sizes from a single sheet of material, the present invention maximizes the material that can be used in the sheets and minimizes the amount of scrap material that remains from the manufacturing process.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. For example, although the embodiments all show multiple inner panels that are intended to display objects with a thickness greater than a single inner panel, it will be appreciated that a single inner panel could be used to hold objects that are thinner than its thickness (or its thickness with a set of spacers), such as a document, a banner, or a coin. Additionally, it will be appreciated that some display cases could lay flat on the rear face in which case the longitudinal plane of the rear panel would actually be in a lateral orientation. Thus, the breadth and scope of the present invention should not be limited by any of the above-described exemplary embodiments, but should be defined only in accordance with the following claims appended hereto and their equivalents.

What is claimed is:

1. A modular display case, comprising:

a rear panel, wherein the rear panel has a rear face, a forward facing inner surface, and an outer periphery, and wherein the rear panel is situated in a longitudinal plane;

an inner panel comprising a frame, wherein the inner panel is attached to the rear panel, wherein the frame is comprised of a plurality of side sections and a base portion extending between the side sections, wherein the side sections and the base portion bound an interior space, wherein each of the side sections has an interior edge, an exterior edge, a forward face, and a rearward face, wherein a width of the side sections between the interior edge and the exterior edge is greater than a thickness of the side sections between the forward face and the rearward face, wherein the inner panel has a periphery shape substantially matching and aligned with the outer periphery of the rear panel, and wherein the forward face and the rearward face are each situated in a plane parallel to the longitudinal plane of the rear panel;

a plurality of apertures within the rear panel and the inner panel, wherein the apertures in the rear panel are located proximate to the outer periphery, wherein the apertures in the inner panel are respectively aligned with the apertures in the rear panel along a set of lateral axis that are substantially perpendicular to the longitudinal plane of the rear panel;

a set of mechanical fasteners attaching the rear panel to the inner panel, wherein the set of mechanical fasteners extend along the axes through the apertures of the inner panel and the rear panel;

a front panel spaced from the rear panel by the inner panel, wherein the front panel has a front face, a rearward facing inner surface, a bottom side, and an upper periphery, wherein the front panel has a first position adjacent to the inner panel and a second position spaced away from the inner panel, wherein the upper periphery substantially matches and is aligned with the periphery shape of the inner panel side sections, and wherein the front panel is situated in a plane parallel to the longitudinal plane of the rear panel when engaging the inner panel; and a plurality of releasable fasteners holding the front panel to the inner panel in the first position when the releasable fasteners are engaged with each other and freeing the front panel from the inner panel in the second position when the releasable fasteners are disengaged from each other.

2. The display case of claim 1, further comprising a plurality of inner panels fastened together between the rear panel and the front panel, wherein each one of the inner panels is comprised of the frame with the plurality of side sections, the base portion, the plurality of apertures and the interior space, wherein the interior space for the plurality of inner panels forms a display chamber, and wherein a width of the display chamber between the rear panel and the front panel is greater than the width of the inner panel side sections.

3. The display case of claim 2, wherein the releasable fasteners are comprised of a plurality of magnetic fasteners, wherein a plurality of magnets are fastened to at least one of the rearward facing inner surface proximate to the front panel upper periphery and the forward face of the inner panel side sections, and wherein a plurality of magnetically attractive material segments are fastened opposite from the plurality of magnets to the corresponding one of the forward face of the inner panel side sections and the rearward facing inner surface proximate to the front panel upper periphery.

4. The display case of claim 3, further comprising a first set of spacers, wherein the spacers each have an aperture and are positioned between adjacent inner panels, wherein the axes and the mechanical fasteners extend through the apertures of the respective spacers, and wherein a terminal end of the mechanical fasteners form the magnetically attractive material segments.

5. The display case of claim 4, wherein the base portion in each one of the inner panels is further comprised of a cutout section and a bottom edge below the cutout section, wherein an upper side and a lower side of the cutout section are respectively aligned with the bottom edge, and wherein the cutout section for the plurality of inner panels forms a base chamber.

6. The display case of claim 5, further comprising a light situated in the base chamber.

7. The display case of claim 6, further comprising a base chamber cover, a front base panel, a rear base panel, a diffuser panel, a second set of spacers, and a second set of mechanical fasteners, wherein the base chamber cover has a plurality of apertures spaced along a length of the base chamber cover, wherein the base chamber cover is positioned adjacent to the base chamber, wherein the bottom side of the front panel is seated on a top edge of the base chamber cover, wherein the front base panel is positioned adjacent to the base chamber cover and has a plurality of apertures aligned with the apertures in the base chamber cover, wherein the rear base panel is positioned adjacent to the rear face of the rear panel proximate to the base chamber and has a plurality of apertures aligned with the apertures in the base chamber cover, wherein the second set of spacers are positioned between adjacent pair of inner panels at their base portion, wherein the second set of spacers has a respective set of apertures aligned with the apertures in the base chamber cover, wherein the light is a light panel and is seated on the lower side of the inner panels cutout section, wherein the diffuser panel is positioned between the light panel and the upper side of the inner panels cutout section, and wherein the second set of mechanical fasteners extend through the apertures in the base chamber cover, the front base panel, the rear base panel, and the second set of spacers.

8. The display case of claim 7, wherein the base portion in each one of the inner panels is further comprised of a pair of recesses on opposite sides of the cutout section proximate to the upper side, and wherein opposite lateral ends of the diffuser panel respectively extend into the pair of recesses.

9. The display case of claim 7, wherein the rear panel is further comprised of an upper slit and a lower slit that are respectively aligned with the upper side and the lower side of the cutout section, wherein the base chamber cover is further comprised of a slit that is aligned with the lower side of the cutout section, wherein opposite longitudinal sides of the light panel extend into the lower slit in the rear panel and the slit in the base chamber cover, and wherein a longitudinal side of the diffuser panel extends into the upper slit in the rear panel.

10. The display case of claim 7, wherein at least a portion of an upper edge of the front base panel extends beyond the top edge of the base chamber cover and forms a lip adjacent to the bottom side of the front panel.

11. The display case of claim 7, wherein the second set of spacers have a pair of adjacent sides matching the periphery shape of the inner panels at the side sections proximate to the base portion, wherein the second set of spacers are opaque, and wherein the side sections and base portion of the inner panels are formed from a single piece of transparent plastic material.

12. A modular display case, comprising:

a rear panel, wherein the rear panel has a rear face, a forward facing inner surface, and an outer periphery, and wherein the rear panel is situated in a longitudinal plane;

an inner panel comprising a frame, wherein the inner panel is attached to the rear panel, wherein the frame is comprised of a plurality of side sections and a base portion extending between the side sections, wherein the side sections and the base portion bound an interior space, wherein each of the side sections has an interior edge, an exterior edge, a forward face, and a rearward face, and wherein the inner panel has a periphery shape substantially matching and aligned with the outer periphery of the rear panel;

a front panel spaced from the rear panel by the inner panel, wherein the front panel has a front face, a rearward facing inner surface, a bottom side, and an upper periphery, wherein the upper periphery substantially matches and is aligned with the periphery shape of the inner panel side sections, and wherein the front panel is situated in a plane parallel to the longitudinal plane of the rear panel;

a base cover positioned over and fastened to the base portion of the inner panel, wherein the bottom side of the front panel is seated on a top edge of the base cover; and a front panel base fastened to the base cover, wherein at least a portion of an upper edge of the front base panel extends beyond the top edge of the base cover and forms a lip adjacent to the bottom side of the front panel.

13. The display case of claim 12, further comprising a magnetic fastener releasably connecting the upper periphery of the front panel with at least one of the side sections of the inner panel.

14. The display case of claim 12, further comprising a plurality of inner panels fastened together between the rear panel and the front panel, wherein each one of the inner panels is comprised of the frame with the plurality of side sections, the base portion, and the interior space, wherein a width of the side sections between the interior edge and the exterior edge is greater than a thickness of the side sections between the forward face and the rearward face, wherein the forward face and the rearward face are each situated in a plane parallel to the longitudinal plane of the rear panel, wherein the interior space for the plurality of inner panels forms a display chamber, wherein the base portion in each one of the inner panels is further comprised of a cutout section and a bottom edge below the cutout section, wherein an upper side and a lower side of the cutout section are respectively aligned with the bottom edge, wherein the cutout section for the plurality of inner panels forms a base chamber, and wherein the base cover is positioned over the base chamber.

15. The display case of claim 14, further comprising a plurality of ring magnets, a plurality of mechanical fasteners, a plurality of spacers, a light panel, and a diffuser panel, wherein the rear panel and each one of the inner panels have a plurality of apertures, wherein the apertures in the rear panel are located proximate to the outer periphery, wherein the apertures in the inner panels are respectively aligned with the apertures in the rear panel along a set of lateral axes that are substantially perpendicular to the longitudinal plane of the rear panel, wherein the spacers each have an aperture and are positioned between adjacent pair of inner panels, wherein the axes extend through the apertures of the respective spacers, wherein the mechanical fasteners extend along the axes through the apertures of the inner panels and the spacers, wherein the ring magnets are fastened to the rearward facing inner surface of the front panel at corners of the upper periphery, wherein a terminal end of the mechanical fasteners adjacent to the magnets are formed from a magnetically attractive material, wherein the light panel and is seated on the lower side of the inner panels cutout section, and wherein the diffuser panel is positioned between the light panel and the upper side of the inner panels cutout section.

16. A modular display case, comprising:

a plurality of inner panels fastened together, wherein the inner panels are each comprised of an upper portion and a base portion, wherein the upper portion of at least one of the inner panels extends above the base portion, wherein the base portion in each of the inner panels is further comprised of a cutout section between an upper side and a lower side and collectively forms a base chamber in the inner panels;

a base chamber cover connected to at least one of the inner panels and positioned adjacent to the base chamber;

a light situated in the base chamber; and a diffuser panel held within the base chamber and situated between the light and the upper portion of the inner panels.

17. The display case of claim 16, wherein the top portion of each one of the inner panels comprises a frame having a first shape, wherein the frame is comprised of a plurality of side sections, wherein the base portion extends between the side sections, wherein the side sections and the base portion bound an interior space forming a display chamber, wherein each of the side sections has an interior edge, an exterior edge, a forward face, and a rearward face, wherein a width of the side sections between the interior edge and the exterior edge is greater than a thickness of the side sections between the forward face and the rearward face, and wherein the upper side of the base portion divides the base chamber from the display chamber.

18. The display case of claim 17 wherein the frame of the inner panels is formed from a solid panel with an internal region removed to produce the interior space within the frame, wherein the internal region has a second shape that is a scaled-down copy of the first shape, wherein a scaled-down internal region is removed from the internal region to form a scaled-down frame, and wherein the scaled-down frame forms scaled-down inner panels for a scaled-down version of the display case.

19. The display case of claim 16, wherein the upper portion for a first set of the inner panels has a first shape, and wherein the upper portion for a second set of the inner panels has a second shape different from the first shape.

20. The display case of claim 19, wherein the upper portion is further comprised of an etched indicia in a face of at least one of the first set of the inner panels and the second set of the inner panels.

* * * * *